US008171987B2

(12) United States Patent
Jiang et al.

(10) Patent No.: US 8,171,987 B2
(45) Date of Patent: May 8, 2012

(54) MINICHANNEL HEAT EXCHANGER HEADER INSERT FOR DISTRIBUTION

(75) Inventors: Yirong Jiang, Ellington, CT (US); Jules R. Munoz, South Windsor, CT (US); Young K. Park, Simsbury, CT (US); Parmesh Verma, Manchester, CT (US)

(73) Assignee: Carrier Corporation, Farmington, CT (US)

( * ) Notice: Subject to any disclaimer, the term of this patent is extended or adjusted under 35 U.S.C. 154(b) by 95 days.

(21) Appl. No.: 12/513,787

(22) PCT Filed: Nov. 13, 2006

(86) PCT No.: PCT/US2006/043903

§ 371 (c)(1),
(2), (4) Date: Jul. 27, 2010

(87) PCT Pub. No.: WO2008/060270

PCT Pub. Date: May 22, 2008

(65) Prior Publication Data

US 2010/0282454 A1 Nov. 11, 2010

(51) Int. Cl.
*F28F 9/22* (2006.01)
*F25B 39/02* (2006.01)

(52) U.S. Cl. ..... 165/174; 62/504

(58) Field of Classification Search ..... 165/174; 62/504, 527

See application file for complete search history.

(56) References Cited

U.S. PATENT DOCUMENTS

| | | | | |
|---|---|---|---|---|
| 1,662,236 | A * | 3/1928 | Coupland | 165/174 |
| 2,143,565 | A * | 1/1939 | Minea | 137/600 |
| 3,074,478 | A * | 1/1963 | Ertz | 165/101 |
| 3,976,128 | A | 8/1976 | Patel et al. | |
| 5,651,268 | A | 7/1997 | Aikawa et al. | |
| 5,806,586 | A | 9/1998 | Osthues et al. | |
| 6,179,051 | B1 * | 1/2001 | Ayub | 165/167 |
| 6,199,401 | B1 * | 3/2001 | Haussmann | 62/525 |
| 6,505,478 | B1 * | 1/2003 | Cousineau et al. | 62/305 |
| 6,729,386 | B1 * | 5/2004 | Sather | 165/110 |
| 7,086,249 | B2 * | 8/2006 | Bae et al. | 62/504 |
| 7,331,195 | B2 * | 2/2008 | Bae et al. | 62/504 |
| 7,806,171 | B2 * | 10/2010 | Taras et al. | 165/174 |
| 2002/0174978 | A1 | 11/2002 | Beddome et al. | |
| 2003/0010483 | A1 | 1/2003 | Ikezaki et al. | |
| 2007/0114013 | A1 * | 5/2007 | Augenstein et al. | 165/174 |

FOREIGN PATENT DOCUMENTS

JP 06159983 A * 6/1994

OTHER PUBLICATIONS

International Search Report and Written Opinion mailed Apr. 9, 2007 (7 pgs.).

* cited by examiner

*Primary Examiner* — Allen Flanigan
(74) *Attorney, Agent, or Firm* — Cantor Colburn LLP

(57) ABSTRACT

An inlet header of a microchannel heat exchanger is provided with a first insert disposed within the inlet header and extending substantially the length thereof, and having a plurality of openings for the flow of refrigerant into the internal confines of the inlet header and then to the channels. A second insert, disposed within the first insert, extends substantially the length of the first insert and is of increasing cross sectional area toward its downstream end such that annular cavity is formed between the first and second insert. The annular cavity of decreasing cross sectional area provides for the maintenance of a substantially constant mass flux of the refrigerant along the length of the annulus so as to thereby maintain an annular flow regime of the liquid and thereby promote uniform flow distribution to the channels.

12 Claims, 1 Drawing Sheet

MINICHANNEL HEAT EXCHANGER HEADER INSERT FOR DISTRIBUTION

BACKGROUND OF THE INVENTION

This invention relates generally to air conditioning and refrigeration systems and, more particularly, to parallel flow evaporators thereof.

A definition of a so-called parallel flow heat exchanger is widely used in the air conditioning and refrigeration industry now and designates a heat exchanger with a plurality of parallel passages, among which refrigerant is distributed to flow in an orientation generally substantially perpendicular to the refrigerant flow direction in the inlet and outlet manifolds. This definition is well adapted within the technical community and will be used throughout the text.

Refrigerant maldistribution in refrigerant system evaporators is a well-known phenomenon. It causes significant evaporator and overall system performance degradation over a wide range of operating conditions. Maldistribution of refrigerant may occur due to differences in flow impedances within evaporator channels, non-uniform airflow distribution over external heat transfer surfaces, improper heat exchanger orientation or poor manifold and distribution system design. Maldistribution is particularly pronounced in parallel flow evaporators due to their specific design with respect to refrigerant routing to each refrigerant circuit. Attempts to eliminate or reduce the effects of this phenomenon on the performance of parallel flow evaporators have been made with little or no success. The primary reasons for such failures have generally been related to complexity and inefficiency of the proposed technique or prohibitively high cost of the solution.

In recent years, parallel flow heat exchangers, and brazed aluminum heat exchangers in particular, have received much attention and interest, not just in the automotive field but also in the heating, ventilation, air conditioning and refrigeration (HVAC&R) industry. The primary reasons for the employment of the parallel flow technology are related to its superior performance, high degree of compactness and enhanced resistance to corrosion. Parallel flow heat exchangers are now utilized in both condenser and evaporator applications for multiple products and system designs and configurations. The evaporator applications, although promising greater benefits and rewards, are more challenging and problematic. Refrigerant maldistribution is one of the primary concerns and obstacles for the implementation of this technology in the evaporator applications.

As known, refrigerant maldistribution in parallel flow heat exchangers occurs because of unequal pressure drop inside the channels and in the inlet and outlet manifolds, as well as poor manifold and distribution system design. In the manifolds, the difference in length of refrigerant paths, phase separation and gravity are the primary factors responsible for maldistribution. Inside the heat exchanger channels, variations in the heat transfer rate, airflow distribution, manufacturing tolerances, and gravity are the dominant factors. Furthermore, the recent trend of the heat exchanger performance enhancement promoted miniaturization of its channels (so-called minichannels and microchannels), which in turn negatively impacted refrigerant distribution. Since it is extremely difficult to control all these factors, many of the previous attempts to manage refrigerant distribution, especially in parallel flow evaporators, have failed.

In the refrigerant systems utilizing parallel flow heat exchangers, the inlet and outlet manifolds or headers (these terms will be used interchangeably throughout the text) usually have a conventional cylindrical shape. When the two-phase flow enters the header, the vapor phase is usually separated from the liquid phase. Since both phases flow independently, refrigerant maldistribution tends to occur.

If the two-phase flow enters the inlet manifold at a relatively high velocity, the liquid phase (droplets of liquid) is carried by the momentum of the flow further away from the manifold entrance to the remote portion of the header. Hence, the channels closest to the manifold entrance receive predominantly the vapor phase and the channels remote from the manifold entrance receive mostly the liquid phase. If, on the other hand, the velocity of the two-phase flow entering the manifold is low, there is not enough momentum to carry the liquid phase along the header. As a result, the liquid phase enters the channels closest to the inlet and the vapor phase proceeds to the most remote ones. Also, the liquid and vapor phases in the inlet manifold can be separated by the gravity forces, causing similar maldistribution consequences. In either case, maldistribution phenomenon quickly surfaces and manifests itself in evaporator and overall system performance degradation.

In tube-and-fin type heat exchangers, it has been common practice to provide individual capillary tubes or other expansion devices leading to the respective tubes in order to get relatively uniform expansion of a refrigerant into the bank of tubes. Another approach has been to provide individual expansion devices such as so-called "dixie" cups at the entrance opening to the respective tubes, for the same purpose. Neither of these approaches are practical in minichannel or microchannel applications, wherein the channels are relatively small and closely spaced such that the individual restrictive devices could not, as a practical manner, be installed within the respective channels during the manufacturing process.

In the air conditioning and refrigeration industry, the terms "parallel flow" and "minichannel" (or "microchannel") are often used interchangeably in reference to the abovementioned heat exchangers, and we will follow similar practice. Furthermore, minichannel and microchannel heat exchangers differ only by a channel size (or so-called hydraulic diameter) and can equally benefit from the teachings of the invention. We will refer to the entire class of these heat exchangers (minichannel and microchannel) as minichannel heat exchangers throughout the text and claims.

SUMMARY OF THE INVENTION

Briefly, in accordance with one aspect of the invention, the inlet header of a parallel flow heat exchanger is provided with a pair of inserts installed within the header, with an outer insert receiving the fluid flow in its one end and having a plurality of spaced openings discharging into the header, and with an inner insert extending substantially along the length of the outer insert and having a cross sectional area that increases along its length so as to maintain a substantially constant mass flux of refrigerant flow in the annulus between the two inserts.

By another aspect of the invention, the inner insert is concentrically disposed within the outer insert and is secured thereto at its downstream end.

By yet another aspect of the invention, the inner insert is circular in cross sectional shape and tapered so as to provide an annulus with a doughnut shaped cross section.

In the drawings as hereinafter described, a preferred embodiment is depicted; however, various other modifications and alternate designs and constructions can be made thereto without departing from the spirit and scope of the invention.

DESCRIPTION OF THE PREFERRED EMBODIMENT

Figure 1:
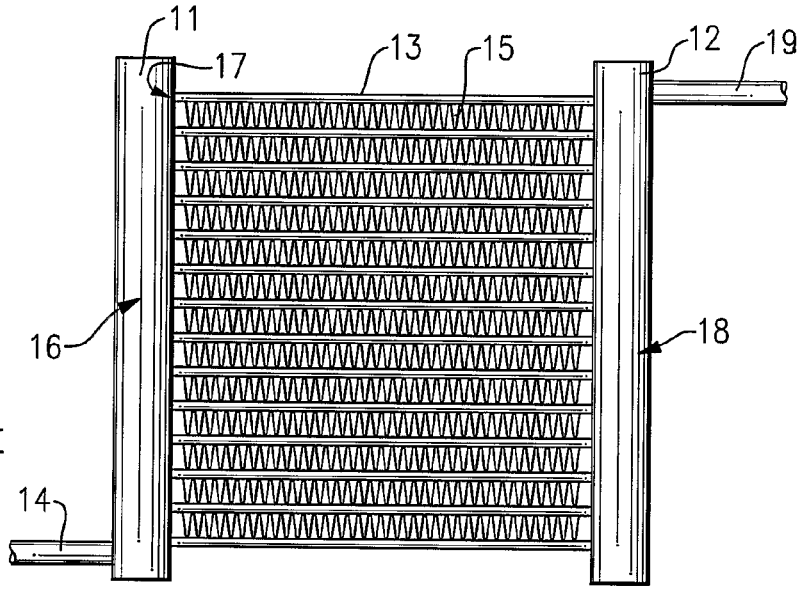
FIG.1 Prior Art
FIG. 1 is a schematic illustration of a parallel flow heat exchanger in accordance with the prior art.

Referring now to FIG. 1, a parallel flow heat exchanger is shown to include an inlet header or manifold 11, an outlet header or manifold 12 and a plurality of parallel channels 13 fluidly interconnecting the inlet manifold 11 to the outlet manifold 12. Generally, the inlet and outlet manifolds 11 and 12 are cylindrical in shape, and the channels 13 are usually tubes (or extrusions) of flattened shape. Channels 13 normally have a plurality of internal and external heat transfer enhancement elements, such as fins 15.

In operation, two-phase refrigerant flows into the inlet opening 14 and into the internal cavity 16 of the inlet header 11. From the internal cavity 16, the refrigerant, in the form of a liquid, a vapor or a mixture of liquid and vapor (the latter is a typical scenario) enters the channel openings 17 to pass through the channels 13 to the internal cavity 18 of the outlet header 12. From there, the refrigerant, which is now usually in the form of a vapor, passes out the outlet opening 19 and then to the compressor (not shown).

As discussed hereinabove, it is desirable that the two-phase refrigerant passing from the inlet header 11 to the individual channels 13 do so in a uniform manner (or in other words, with equal vapor quality) such that the full heat exchange benefit of the individual channels can be obtained and flooding conditions are not created and observed at the compressor suction. However, because of various phenomena as discussed hereinabove, a non-uniform flow of refrigerant to the individual channels 13 (so-called maldistribution) occurs. In order to address this problem, the applicants have introduced design features that will promote a uniform distribution of refrigerant to the individual channels.

Figure 2:
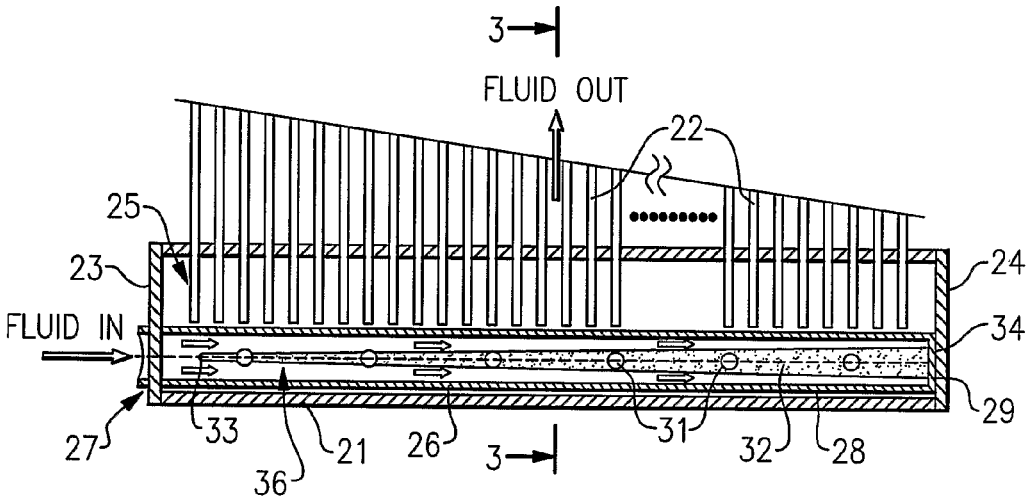
FIG. 2 is a longitudinal sectional view of an inlet manifold in accordance with the present invention.
Figure 3:
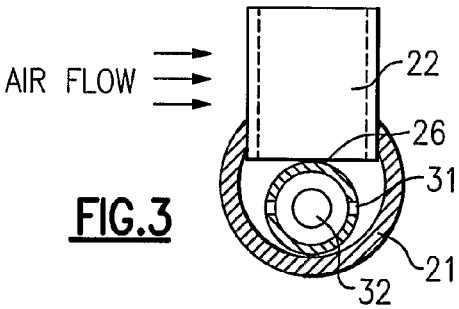
FIG. 3 is a sectional view thereof as seen along lines 3-3 of FIG. 2.

Referring now to FIG. 2, the inlet manifold of the present invention is shown at 21 as fluidly attached to a plurality of channels 22. The inlet manifold 21 has end caps 23 and 24 at the inlet end and the downstream end, respectively. The end caps 23 and 24, along with the side walls of the inlet manifold define an internal cavity 25 into which the channels extend for receiving refrigerant flow therefrom.

Disposed within the inlet manifold 21 is a first, or outer, insert 26 which extends through an opening 27 at the inlet end of the inlet manifold 21 and extends substantially the length of the inlet manifold 21 as shown. The outer insert 26 as shown is tubular in form having side walls 28 and an end wall 29 which may be secured to the end cap 24 by welding or the like. However, it should be recognized that the outer insert 26 may be of any shape that would fit into the inlet manifold 21. Therefore, in addition to the circular cross sectional shape as shown, it may also be D-shaped, kidney shaped, a plate insert, or the like.

A plurality of holes 31 are formed in the outer insert 26. The holes 31 are preferably uniformly spaced but may be non-uniformly spaced if it is found desirable for purposes of uniform distribution. Further, although the holes 31 are shown as being formed on either side of the first insert 26 (i.e. with their axes formed at a 90° with the axes of the channels 22), the size, shape and placement of the holes may be varied as desired to accomplish the desired uniform distribution.

A second, or inner, insert 32 is disposed within the first insert 26 as shown. The inner insert 32 extends substantially the length of the outer insert 26 and has a pointed shape at its one, or upstream, end 33 and gradually increases in cross sectional size towards its other, or downstream, end 34 which is attached to the end wall 29 as by welding or the like.

It will thus be seen that the combination of the outer insert 26 and the inner insert 32 defines an annular cavity 36 that decreases in radial extent as it proceeds toward its downstream end 34. This structure is conducive to uniform flow distribution as will be described hereinafter.

It should be recognized that the inner insert 32, in addition to being a solid rod as shown, may be of various other shapes and designs such as a hollow rod, twisted tubes, or have a cross sectional shape of various design such as circular, D-shape or rectangular. The surface of the inner insert 32 may be smooth or it may be grooved to create a swirl effect to improve liquid-vapor mixing. It can also be formed of a foam/porous material so as to promote turbulence which would help mixing the vapor and liquid to obtain a more homogeneous flow. As such, it may be of uniform or non-uniform void fraction, and if non-uniform, then with higher void fraction at the inlet of the first inlet and reduced void fraction at the downstream end thereof.

Considering now the effect that the present design has on the flow characteristics, it should be recognized that the preferred flow regimes are either annular or dispersed. Dispersed mist flow is homogenous flow where liquid and vapor do not separate, and therefore does not present a maldistribution problem. With annular flow, there is a thin layer of liquid fluid at the inner wall of the first insert 26. Studies show that this flow characteristic can assist in distributing the liquid as well as the vapor more evenly through the distributing holes 31. However, without the second insert 32, as the fluid flows downstream in the first insert 26, its mass flow rate decreases significantly due to the fluid dispensing through the holes 31, causing the flow to change to a wavy or wavy stratified flow regime towards the end 29 of the first insert 26. Even though the flow may still be high enough to be in the annular regime, the thickness of the liquid layer could reduce substantially, resulting in liquid dry-out at the orifice toward the end of the first insert.

With the use of the second insert 32, with its associated annulus of decreasing dimensions, a relatively constant mass flux is maintained and the flow remains in the desired annular regime. Further, it helps to avoid liquid pooling at the end of the first insert. Both of these features will improve the two-phase flow distribution and thus the efficiency of the heat exchanger.

We claim:

1. A parallel flow heat exchanger comprising:

an inlet header having an inlet opening for conducting the flow of fluid into said inlet header and a plurality of outlet openings for conducting the flow of fluid from said inlet header;

a plurality of channels aligned in a substantially parallel relationship and fluidly connected to said plurality of outlet openings for conducting the flow of fluid from said inlet header;

a first insert disposed within said inlet header and being fluidly connected at its one end to said inlet opening, said first insert extending substantially the length of said inlet header and having a plurality of openings therein for conducting the flow of refrigerant from said first insert to said inlet header; and a second insert disposed within said first insert and extending substantially the length of said first insert, said second insert being of increasing cross sectional area and defining, with said first insert, an annulus of decreasing area as it extends away from said inlet opening.

2. A parallel flow heat exchanger as set forth claim 1 wherein said second insert is disposed substantially in concentric relationship with said first insert.

3. A parallel flow heat exchanger as set forth claim 1 wherein said first insert comprises a tube with a circular cross section.

4. A parallel flow heat exchanger as set forth claim 1 wherein said second insert is a tapered rod.

5. A parallel flow heat exchanger as set forth claim 1 wherein said plurality of said openings are formed on either side of said first insert.

6. A parallel flow heat exchanger as set forth claim 5 wherein said plurality of openings are aligned with their axes substantially normal to the axes of said plurality of said channels.

7. A method of promoting uniform refrigerant flow from an inlet header of a heat exchanger to a plurality of parallel minichannels fluidly connected thereto, comprising the steps of:

forming a tube with an inlet end, a downstream end and a plurality of openings therebetween;

mounting said tube within said inlet header such that it extends substantially the length of said inlet header to allow refrigerant to flow into said inlet end and through said tube and out of said plurality of openings into said inlet header prior to flowing into said plurality of parallel minichannels; and providing an insert disposed within said tube and extending substantially the length of said tube, said insert being of increasing cross sectional area and defining with the tube, an annulus of decreasing area as it extends away from an inlet opening to said inlet header.

8. A method of promoting uniform refrigerant flow as set forth claim 7 wherein said insert is disposed substantially in concentric relationship with said tube.

9. A method of promoting uniform refrigerant flow as set forth claim 7 wherein said tube has a circular cross section.

10. A method of promoting uniform refrigerant flow as set forth claim 7 wherein said insert is a tapered rod.

11. A method of promoting uniform refrigerant flow as set forth claim 7 wherein said plurality of openings are formed on either side of said tube.

12. A method of promoting uniform refrigerant flow as set forth claim 11 wherein said plurality of openings are aligned with their axes substantially normal to the axes of said plurality of said minichannels.

* * * * *